US008223086B2

(12) United States Patent
Hansen

(10) Patent No.: US 8,223,086 B2
(45) Date of Patent: Jul. 17, 2012

(54) DISK MONOPOLE ANTENNA STRUCTURE

(75) Inventor: Thomas Hansen, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 1101 days.

(21) Appl. No.: 11/793,119

(22) PCT Filed: Nov. 18, 2005

(86) PCT No.: PCT/EP2005/056064

§ 371 (c)(1),
(2), (4) Date: Nov. 6, 2007

(87) PCT Pub. No.: WO2006/063916

PCT Pub. Date: Jun. 22, 2006

(65) Prior Publication Data

US 2008/0094285 A1 Apr. 24, 2008

(30) Foreign Application Priority Data

Dec. 13, 2004 (DE) ..... 10 2004 059 916

(51) Int. Cl.

| | |
|---|---|
| ***H01Q 1/48*** | (2006.01) |
| ***H01Q 1/38*** | (2006.01) |
| ***H01Q 5/00*** | (2006.01) |
| ***H01Q 9/04*** | (2006.01) |

(52) U.S. Cl. ..... 343/846; 343/700 MS

(58) Field of Classification Search ..... 343/700 MS, 343/702, 846, 908, 829, 750, 752
See application file for complete search history.

(56) References Cited

U.S. PATENT DOCUMENTS

| | | | | |
|---|---|---|---|---|
| 6,249,254 | B1 * | 6/2001 | Bateman et al. | 343/700 MS |
| 2003/0090436 | A1 * | 5/2003 | Schantz et al. | 343/908 |
| 2003/0156064 | A1 | 8/2003 | Bancroft et al. | |
| 2004/0100408 | A1 | 5/2004 | Okado | |
| 2004/0100409 | A1 | 5/2004 | Okado | |
| 2004/0130493 | A1 * | 7/2004 | Horita et al. | 343/702 |

FOREIGN PATENT DOCUMENTS

| | | | |
|---|---|---|---|
| JP | 08 018320 | | 1/1996 |
| JP | 08018320 | A * | 1/1996 |
| JP | 3094677 | | 4/2003 |
| JP | 2003 273638 | | 9/2003 |
| JP | 2003273638 | A * | 9/2003 |
| JP | 2004 282534 | | 10/2004 |
| JP | 2004328693 | | 11/2004 |
| WO | WO 2004/010532 | | 1/2004 |
| WO | WO 2004010531 | A1 * | 1/2004 |

OTHER PUBLICATIONS

International Search Report, PCT International Patent Application No. PCT/EP2005/056064, dated Mar. 3, 2006.

Seong-Youp Suh et al., "Multi-broadband monopole disc antennas", IEEE Antennas and Propagation Society International Symposium, Jun. 22-27, 2003, pp. 616-619, vol. 3, Columbus Ohio.

* cited by examiner

*Primary Examiner* — Douglas W Owens
*Assistant Examiner* — Jennifer F Hu
(74) *Attorney, Agent, or Firm* — Kenyon & Kenyon LLP

(57) ABSTRACT

In a disk monopole antenna structure, a semicircular region is provided, as well as an oppositely disposed, second frame-type region, which faces away from the semicircular region and forms a cut-out in the antenna structure.

10 Claims, 7 Drawing Sheets

DISK MONOPOLE ANTENNA STRUCTURE

BACKGROUND INFORMATION

With regard to the operation of cellular phones used in mobile communication from the inside of a motor vehicle, to an increasing degree, antennas are being installed outside of the motor vehicle to improve the quality of the communication. In this way, depending on the installation location, the shielding effect provided by the vehicle's outer skin, which is generally made of electrically conductive materials, becomes negligible.

Since there are several cellular radio system providers which operate in different frequency bands, for example from 890 to 960 MHz in Europe, from 1710 to 1880 MHz for GSM, and, in the future, from 1920 to 2170 MHz for UMTS, there is a need for multiband antennas which cover these frequency ranges. Depending on the region, for example Europe and the Americas, these frequency bands are slightly offset from one another, so that an antenna that is optimized for Europe, for example, is not automatically suited for operation in the Americas.

Multiband, roof-mounted antennas, which are based on a monopole-type antenna structure, are often used. Monopole-type antennas have the advantage of an omnidirectional characteristic and of constant polarization ratios. With regard to roof-mounted antennas, current efforts are directed to achieving a lowest possible overall height. For reasons related to safety and to increased risk of injury in accidents involving pedestrians, bikers or motorcyclists, at present, heights of 4 cm are still required for roof-mounted antennas.

Moreover, there is a demand for additional measures to minimize the risk of injury in the event of an accident. As a result, antenna designs have become more complicated and expensive. Moreover, an antenna having a low overall height is able to be integrated more effectively in the general vehicle appearance, which is often a decisive criterion for the automobile manufacturers.

The height of an antenna is determined by the lowest frequency that it is designed to receive. In the case of a mobile radio antenna for Europe, this is 890 MHz. A height of approximately 8 cm (FIG. 1) is derived therefrom for a classic $\lambda/4$ monopole.

However, the overall height can be reduced by configuring the monopole in a meandering or folded shape (FIGS. 2 and 3). Such a reduction in overall height, however, is made at the expense of the attainable bandwidth. It is often precisely by using meandered or folded antennas, for example, that a communications frequency band for one region, such as Europe or the Americas, is able to be covered. A separate antenna must then be developed and provided for the other region in question.

Besides requiring low-height antennas, to an increasing degree, the automotive industry is stipulating that they be able to be used independently of the respective region. From the related art, disk monopole antennas are known, which are adapted to radiate from a lower limit frequency up to several GHz (FIG. 4 through 6). The overall height of such an antenna corresponds approximately to that of a $\lambda/4$ monopole for the same lower limit frequency. In the case of 800 MHz, this is approximately 8 cm.

Coupling elements have been proposed for generating additional resonances when working with a disk monopole. However, they produce only relatively narrow-band resonances, which are not capable, for example, of covering a complete lower 900 MHz cellular radio frequency band for Europe and the Americas.

BRIEF DESCRIPTION OF THE DRAWINGS

Exemplary embodiments of the present invention are explained in greater detail with reference to the figures.

DETAILED DESCRIPTION OF EXAMPLE EMBODIMENTS

In accordance with an example embodiment of the present invention, using a first disk-type, in particular semicircular region and a second frame-type region which faces away from the semicircular region and forms a cut-out (5) in the antenna structure, it is possible to devise an antenna, which, starting at a lower limit frequency, is adapted for ultra-wideband radiation or reception, and which has one or optionally additional narrower-band frequency bands, which preferably reside below the ultra-wideband frequency range and are able to cover a complete lower cellular radio frequency band.

The present invention provides, e.g., a downsized antenna suitable for the regionally independent, mobile communications provided by current and future systems.

Besides providing the at least one additionally usable narrower-band, but nevertheless relatively wide-band frequency band, it is also possible to reduce the overall height. In particular, in accordance with an example embodiment of the present invention, an additional frequency band is created, whose bandwidth is wider than that provided by inductively coupling a conductor rod.

In particular, in one embodiment, it is possible to either provide an additional frequency band, or through a combination with the first frequency band, to create a combined, wider-band frequency band. Thus, along the lines of the present invention, a regionally independent coverage of the lower communications frequency bands for AMPS (the Americas) and GSM (Europe) may also be provided.

Figure 1:
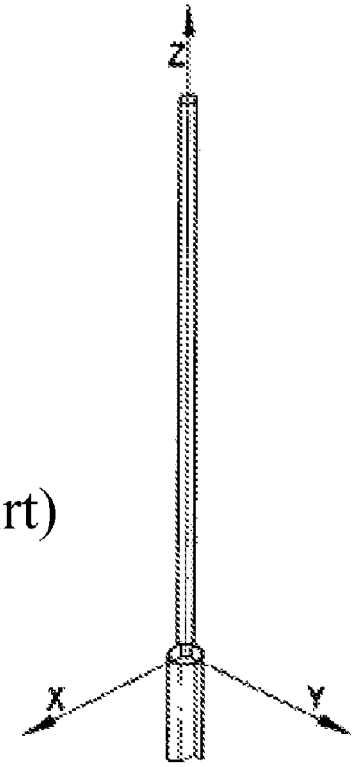
Fig. 1 (Prior Art)
FIGS. 1-6 show monopole antenna configurations.
Figure 2:
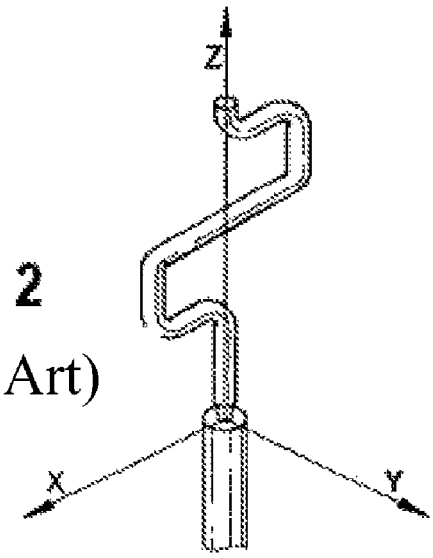
Fig. 2 (Prior Art)
Figure 3:
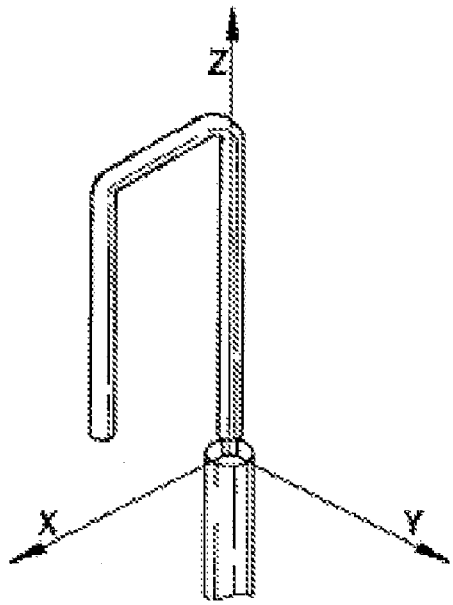
Fig. 3 (Prior Art)
Figure 4:
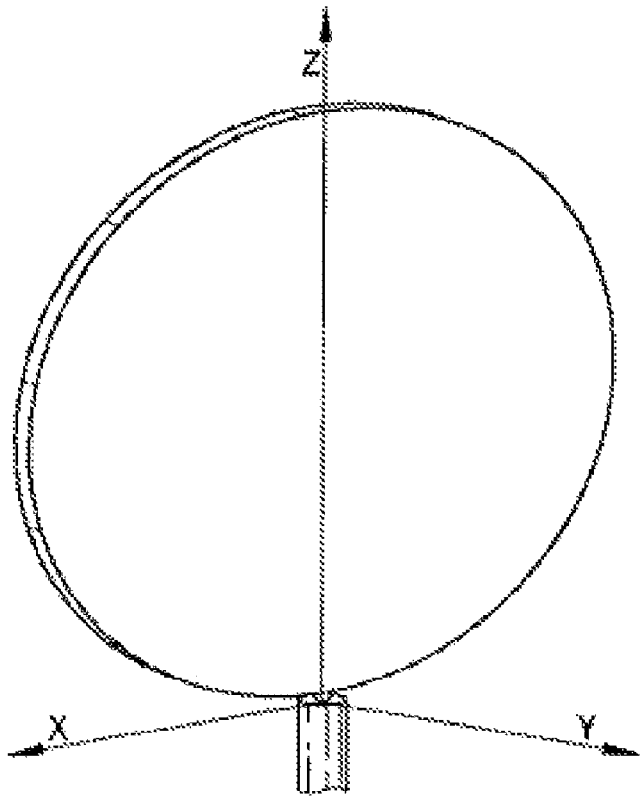
Fig. 4 (Prior Art)
Figure 5:
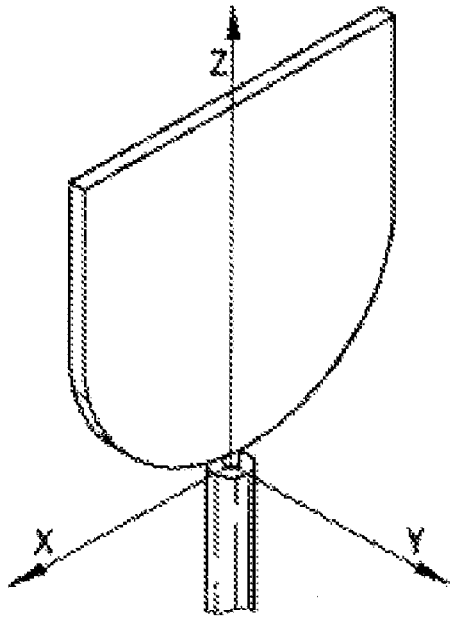
Fig. 5 (Prior Art)
Figure 6:
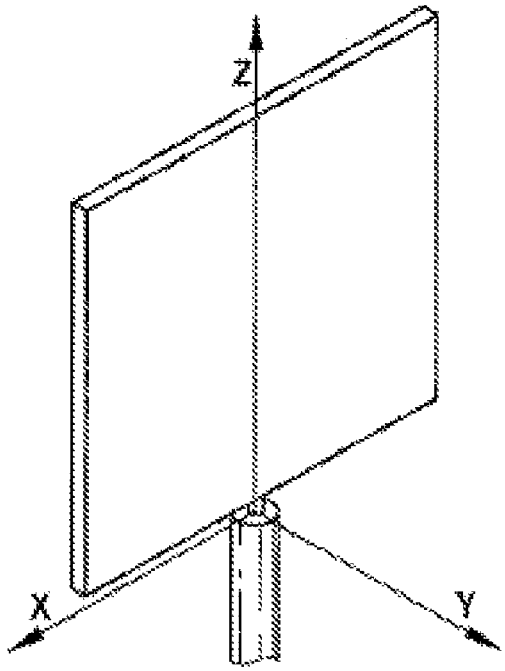
Fig. 6 (Prior Art)
Figure 7:
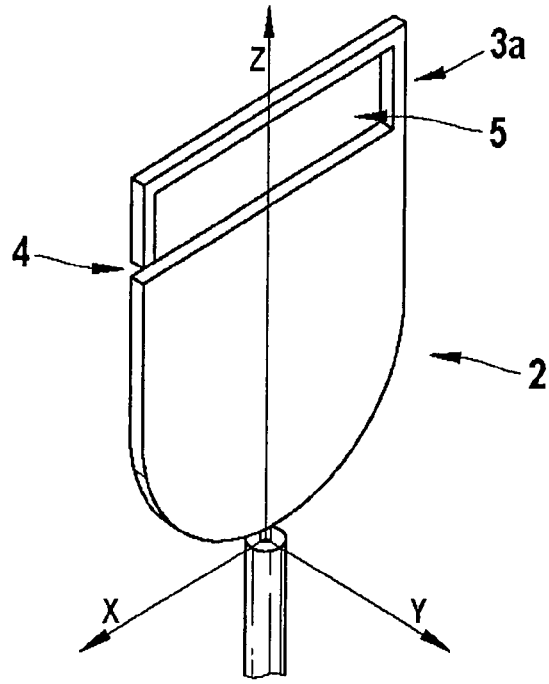
FIG. 7 shows a disk monopole antenna having a galvanically coupled U-shaped conductor.
Figure 9:
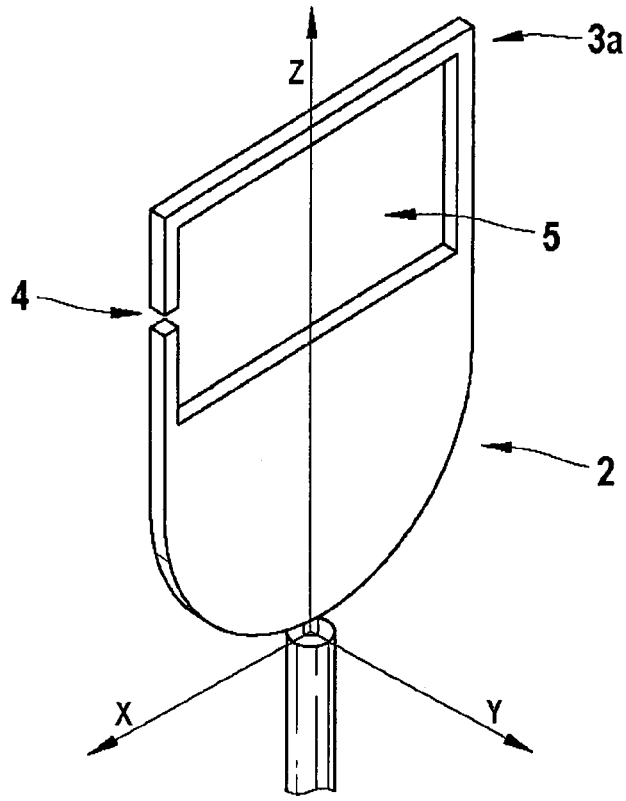
FIG. 9 shows a disk monopole antenna having additional resonance produced by a combination from FIGS. 7 and 8.
Figure 10:
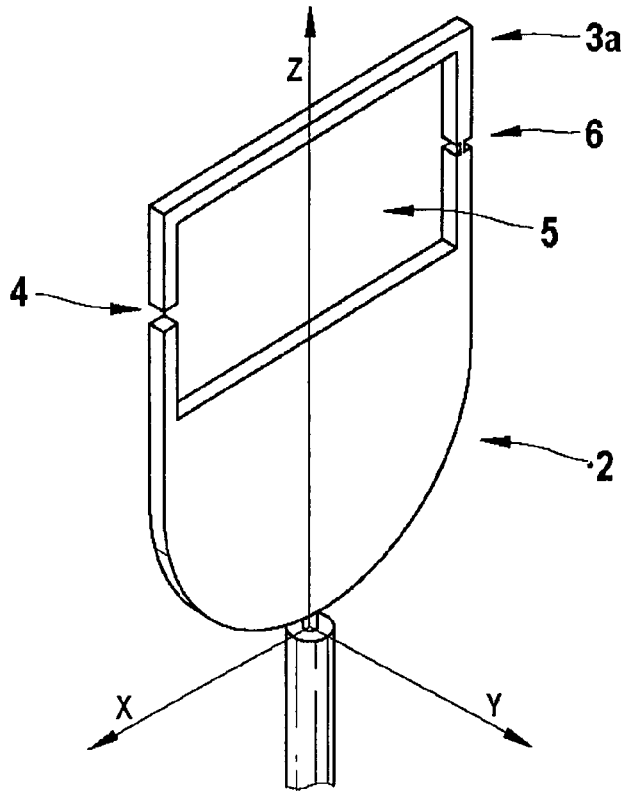
FIG. 10 shows an optimization of the additional resonance via an optional resistor for coupling the additional conductor to the disk monopole.

FIG. 7 illustrates the fundamental principle underlying the antenna in accordance with an example embodiment of the present invention, in the form of a disk monopole structure 2, which is suited both for transmitting and for receiving operation. In its lower region/half, it is semicircular in shape, and it has a frame-type region, which preferably has a rectangular cut-out 5 that faces away from the semicircular region, i.e., that is disposed at the opposite end thereof. Due to the configuration of cut-out 5, two conductor strips of uniform size and width are preferably formed at the left and right edges. The height of the disk monopole establishes the lower limit frequency of the ultra-wideband frequency range for higher frequencies. The impedance response of the antenna is determined by the shape of the lower edge of disk monopole structure 2 and its distance to a conductive ground plate (GND plane). Cut-out 5 in the antenna influences both the lower limit frequency of the wide-band frequency range, as well as the further frequency response characteristic for the higher frequencies. Extending transversely to the upper edge of the disk monopole, preferably over the entire width thereof and at a certain distance therefrom, is a first additional folded conductor in the form of a rod 3, which is preferably connected at one of its two ends galvanically or, optionally, via an impedance, for example a resistor 6, to the lateral conductor strips of cut-out disk monopole 2. At the other end, a point of separation remains in the form of a slit 4 between rod 3 and the disk monopole. In the region formed by rod 3 and the edge of cut-out 5 in the disk monopole, a ring current is generated in a specific frequency range, thereby creating an additional frequency band for the antenna. This frequency band preferably resides below the lower limit frequency of the frequency range covered by the disk monopole. The position and configuration of slit 4 substantially determine the formation of the ring current. Instead of using a strictly galvanic coupling, by coupling additional rod 3 via an optional resistor 6, it is possible to favorably influence the impedance response of the antenna in the additional frequency band. The position of optional resistor 6 may deviate from that shown here. Preferably, the position of the additional frequency band may be controlled by the depth of cut-out 5. The first additional rod may be optionally configured to extend upwardly, preferably in a U-shape 3*a* (FIGS. 7, 9 and 10). In this instance, the additional frequency band becomes wider, but also results in a design of greater height.

Figure 8:
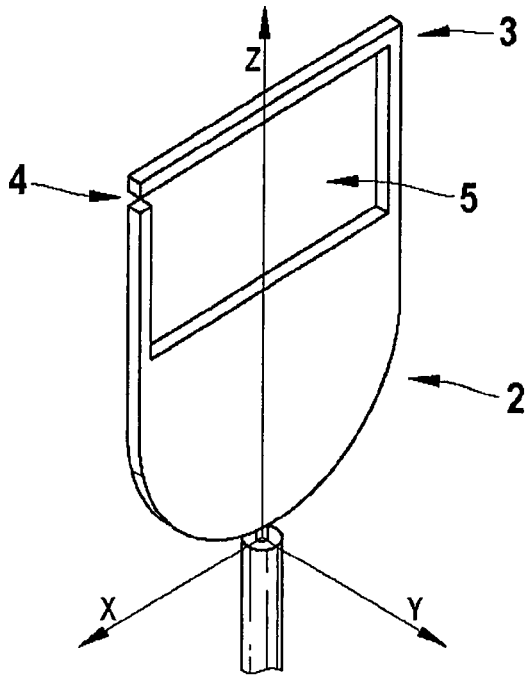
FIG. 8 shows a disk monopole antenna having a galvanically coupled conductor, folded by forming a cut-out in the disk monopole, directing the same to extend inwardly.

While in the exemplary embodiment in accordance with FIG. 7, slit 4 is provided at the base of the frame, thus at the transition to the disk-type region of structure 2, in the exemplary embodiment in accordance with FIG. 8, it is located at the upper frame edge, and thus also at the top edge of the disk monopole. In the exemplary embodiment in accordance with FIG. 9, slit 4 is centrally disposed in one of the lateral conductors.

Figure 12:
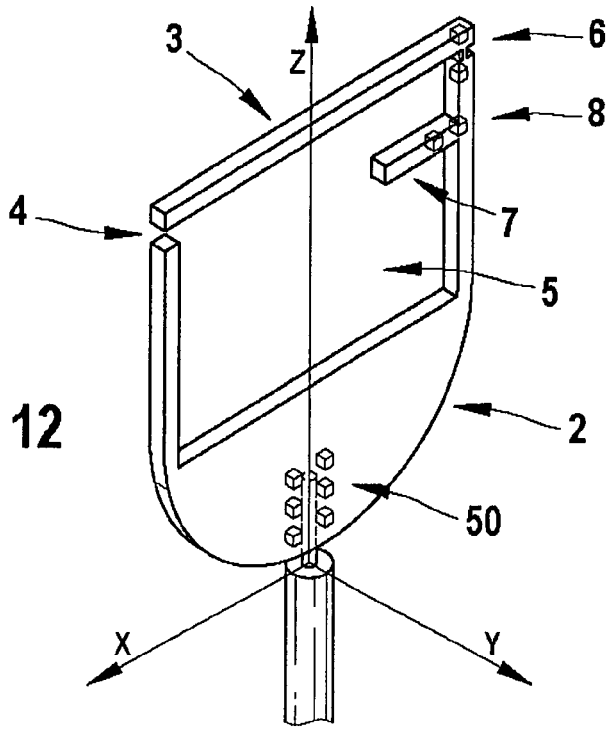
FIG. 12 shows a disk monopole antenna having a further additional resonance, likewise having a circuit board metallized on both sides.

A further additional conductor rod 7 may be optionally introduced into the antenna according to the present invention having a cut-out 5, in the region formed by cut-out 5 and first conductor rod 3 (FIG. 12). Further additional rod 7 is preferably coupled inductively 8 to one of the two strips of disk monopole 2 formed by cut-out 5 and either creates a further additional frequency band, or, together with the first additional frequency band, creates a combined, wider-band frequency band. The position of the second additional frequency band may typically be adjusted via inductance 8 of the coupling, and via the length and the position of second rod 7. The impedance response of the antenna in the frequency band influenced by further rod 7 may also be optimized by connecting an optional active component/resistor in parallel to inductance 8 for coupling further rod 7.

It is, of course, possible for additional rods 7 to be coupled, preferably inductively, to one of the two strips of disk monopole 2 formed by cut-out 5. In this manner, the bandwidth of the additional frequency band may preferably be favorably influenced.

To provide a cost-effective design, the antenna is preferably implemented on a circuit board, preferably composed of a dielectric substrate that is metallized on both sides to the structure of the antenna. Other multi-layer structures that are customary today may likewise be implemented, such as a design where the dielectric substrate remains outside of the metallic structure of the antenna.

Figure 11:
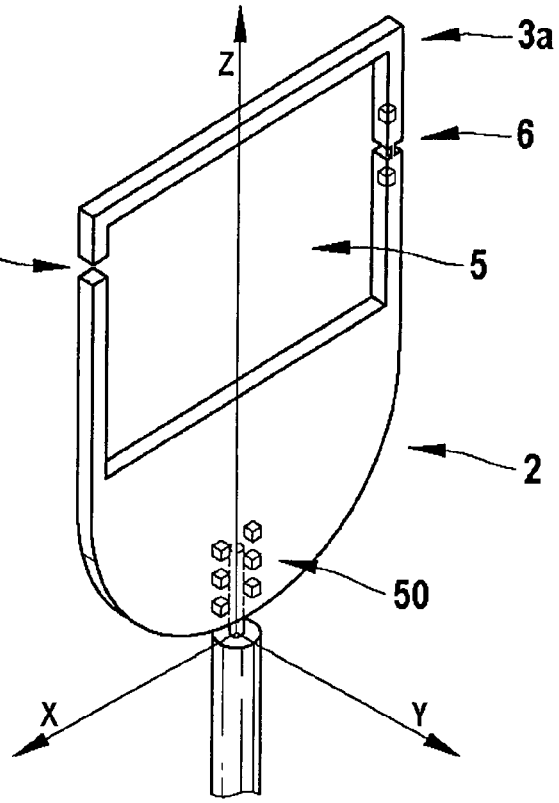
FIG. 11 shows an exemplary implementation of a disk monopole antenna having a circuit board metallized on both sides.

Implementations of this kind having a circuit board that is metallized on both side are shown in FIGS. 11 and 12. The through-connection, which is required, in particular, in the case of one-sided supply, is accomplished by vias 50.

To provide an enhanced integration into the design encompassing the antenna, the shape of cut-out 5 may also deviate from the rectangular. The width of conductor rod 3 preferably remains unchanged relative to the design which includes the rectangular cut-out of FIG. 8.

Figure 13:
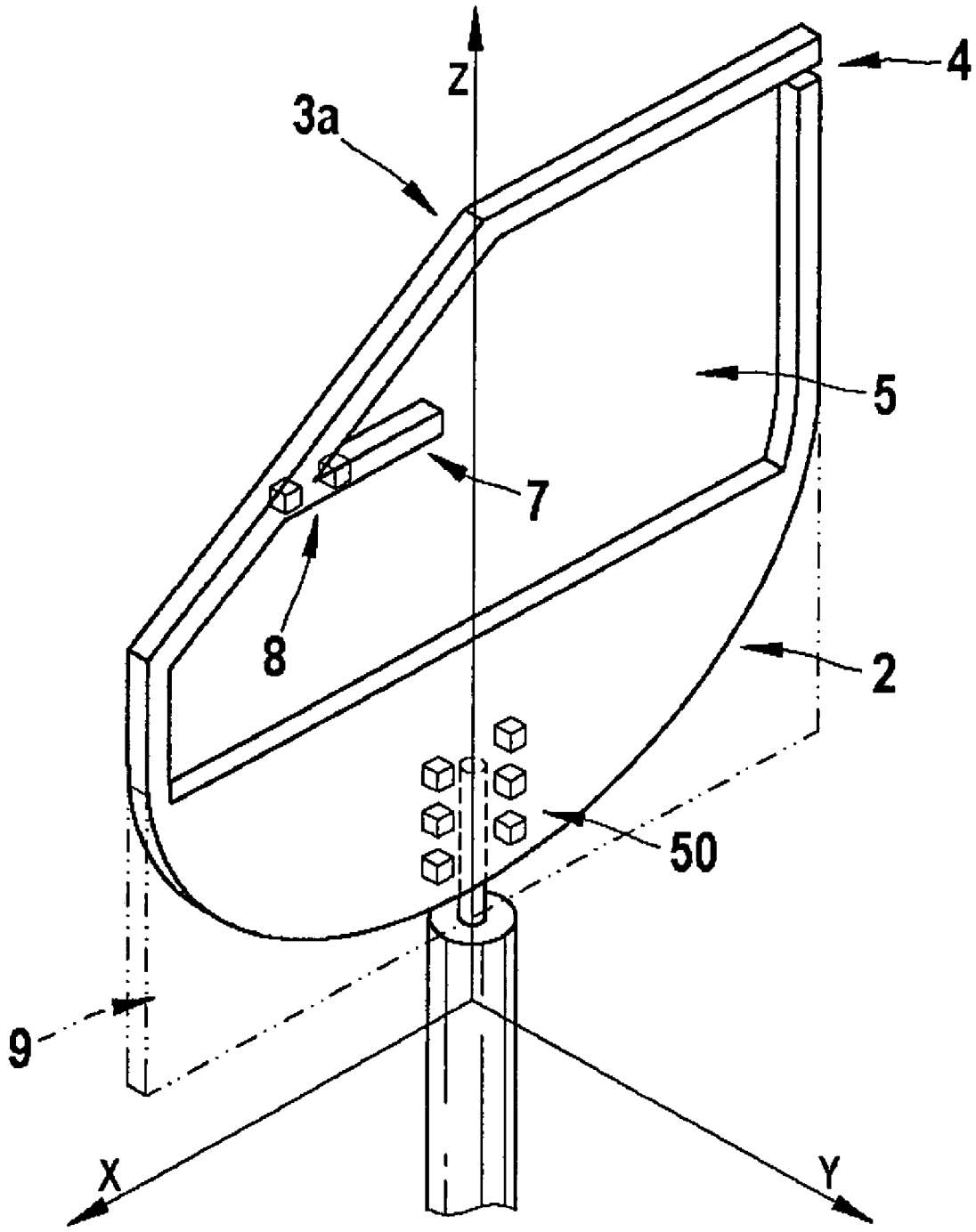
FIG. 13 shows another embodiment with a stream-lined shape.

Thus, a streamlined design is able to be achieved, as shown, for example, in FIG. 13. Further rod 7 which is coupled via an inductor 8 having optional resistance may then preferably be located in oblique edge 3*a*.

Of course, still other rods may be accommodated in cut-out 5, in order to cover additional frequency bands.

What is claimed is:

1. A disk monopole antenna structure, comprising:

a first disk-type, semicircular region; and a second frame-type region which faces away from the semicircular region and forms a cut-out in the antenna structure, the frame-type region including a top conductor and two lateral conductors, one end of each of the lateral conductors being connected to a respective end of the semicircular region;

wherein:

the frame-type region is substantially closed except for a slit in one of the conductors;

the frame-type region is coupled to the disk monopole antenna structure via an impedance element located in one of the conductors of the frame-type region; and the top conductor is U-shaped and has legs, at least one of the legs terminating at the location of the impedance element.

2. The antenna structure as recited in claim 1, wherein the frame-type region is rectangular.

3. The antenna structure as recited in claim 1, wherein the top conductor is U-shaped and has legs, at least one of the legs merging transitionally into one of the two lateral conductors.

4. The antenna structure as recited in claim 1, wherein the top conductor is U-shaped and has legs, at least one of the legs terminating at the location of the slit.

5. The antenna structure as recited in claim 1, further comprising:

at least one additional conductor, which is separate from the conductor having the slit, one end of the additional conductor conterminously originating from one of the conductors of the frame-type region, and extending into the cut-out to terminate at a free-hanging end, the additional conductor being conductively coupled to the disk monopole antenna structure via the coterminous end.

6. A disk monopole antenna structure, comprising:

a first disk-type, semicircular region;

a second frame-type region which faces away from the semicircular region and forms a cut-out in the antenna structure, the frame-type region including a top conductor and two lateral conductors, one end of each of the lateral conductors being connected to a respective end of the semicircular region; and at least one additional conductor, one end of the additional conductor conterminously originating from one of the conductors of the frame-type region, and extending into the cut-out to terminate at a free-hanging end, the additional conductor being conductively coupled to the disk monopole antenna structure via the coterminous end;

wherein:

the frame-type region is substantially closed except for a slit in one of the conductors; and the coupling of the additional conductor to the disk monopole antenna structure is performed via an inductive element connected in parallel to a resistor.

7. The antenna structure as recited in claim 1, wherein the conductors of the frame-type region each has one of a strip-shaped or rod-shaped design.

8. The antenna structure as recited in claim 1, wherein the frame-type region is non-rectangular.

9. The antenna structure as recited in claim 1, wherein the antenna structure is implemented on a circuit board composed of a dielectric substrate that is metallized on both sides to form the structure of the antenna.

10. The antenna structure as recited in claim 1, wherein:

the size and dimensions of the cut-out provide a wide-band radiation range for the antenna structure, the wide-band radiation range extending from a lower limit frequency to an upper limit frequency; and the location and the width of the slit create an additional frequency band for the antenna structure, the additional frequency band located within a narrow-band radiation range that is below the lower limit frequency.

* * * * *